United States Patent [19]

Stout et al.

[11] Patent Number: 4,898,274

[45] Date of Patent: Feb. 6, 1990

[54] DOUBLED HANGING GARMENT BAG

[75] Inventors: Darwin E. Stout; Robert C. Wilcox; Charles A. Peloquin, all of Memphis, Tenn.

[73] Assignee: The Trojan Luggage Company, Memphis, Tenn.

[21] Appl. No.: 91,399

[22] Filed: Aug. 26, 1987 (Under 37 CFR 1.47)

[51] Int. Cl.[4] ..... A45C 5/12; A45C 13/00; A45C 13/10; B65D 85/18

[52] U.S. Cl. ..... 206/289; 206/287.1; 190/108; 190/111; 190/113; 190/903

[58] Field of Search ..... 206/278, 287, 287.1, 206/289, 279; D3/71, 76; 190/100, 107, 108, 109, 111, 113, 127; 383/37; 150/111, 113

[56] References Cited

U.S. PATENT DOCUMENTS

| | | | |
|---|---|---|---|
| D. 280,782 | 10/1985 | Cooper | D3/71 |
| D. 285,869 | 9/1986 | Ronen | D3/71 |
| 2,154,630 | 4/1939 | Marbury et al. | 190/111 |
| 2,533,333 | 12/1950 | Kitson | 190/107 X |
| 2,606,636 | 8/1952 | Braverman | 190/113 X |
| 2,774,450 | 12/1956 | Smallberg | 190/113 X |
| 3,221,848 | 12/1965 | O'Neil | 190/127 |
| 3,291,266 | 12/1966 | Komroff | 190/113 X |
| 3,315,772 | 4/1967 | Katz | 206/287.1 |
| 3,542,170 | 11/1970 | Bialo | 206/287.1 X |
| 4,081,061 | 3/1978 | Tucker | 190/108 |
| 4,156,420 | 5/1979 | Darbonnier | 190/111 |
| 4,236,634 | 12/1980 | Benedict | 206/287 |
| 4,436,189 | 3/1984 | Baum | 190/108 |
| 4,542,824 | 9/1985 | Allen | 206/287.1 |

FOREIGN PATENT DOCUMENTS

| | | | |
|---|---|---|---|
| 1073259 | 9/1954 | France | 190/111 |
| 626557 | 10/1961 | Italy | 206/289 |
| 627282 | 8/1949 | United Kingdom | 190/111 |

*Primary Examiner*—Sue A. Weaver
*Attorney, Agent, or Firm*—Daniel E. McConnell

[57] ABSTRACT

A doubled hanging garment bag is provided in which first and second garment bags, each with its own characteristics, are provided with a closure encircling the peripheries of the bags and permitting selective joining of the bags. Thus, when a larger amount of space is required as for the carrying of a larger number of garments, the bags may be joined together for handling as one. When a smaller amount of space is required, the bags may be separated and only one used.

8 Claims, 2 Drawing Sheets

DOUBLED HANGING GARMENT BAG

FIELD AND BACKGROUND OF INVENTION

This invention relates to luggage, and more particularly to an improved hanging garment bag.

Hanging garment bags have been known and used for some time, and most travelers are now familiar with them. Such bags are shown and described, for example, in Kitson U.S. Pat. No. 2,533,333; Komroff U.S. Pat. No. 3,291,266; Myers U.S. Pat. No. 4,489,829; and Allen U.S. Pat. No. 4,542,824, to which the interested reader is referred.

While such bags have achieved some wide spread use, there are limits imposed on the number of garments which can easily be carried in such bags by the very nature of the bags themselves. Typically, no more than three suits or an approximate corresponding number of dresses or the like may be carried. Further, bags have conventionally been made in styles for men and styles for women, with the bags being differently constructed due to perceived differences in the packing needs of men and women. Little has been done to facilitate traveling with larger numbers of garments or a wider range of types of garments.

BRIEF DESCRIPTION OF INVENTION

With the foregoing in mind, it is an object of this invention to provide a doubled hanging garment bag which is capable of accommodating a wider range of numbers and types of garments, while preserving the possibility that the luggage carried may be adapted to the specific garments being taken. In realizing this object of the present invention, a doubled bag is provided in that first and second garment bags, each with its own characteristics, are provided with a closure encircling the peripheries of the bags and permitting selective joining of the bags. Thus, when a larger amount of space is required as for the carrying of a larger number of garments, the bags may be joined together for handling as one. When a smaller amount of space is required, the bags may be separated and only one used.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

Figure 1:
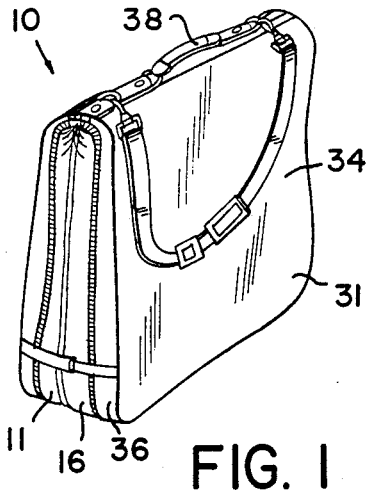
FIG. 1 is perspective view of first and second garment bags in accordance with this invention, joined together and folded for carrying and handling.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the drawings, the present invention contemplates a doubled, hanging garment bag indicated generally at 10 which is formed by the cooperation of first and second elongate, rectangular garment bags indicated respectively at 11 and 31. Each of the bags 11, 31 has certain features in common with the other, and each has certain distinctive features, as will be addressed hereinafter. The bags 11, 31 have in common the use of outer side members (respectively indicated at 14 and 34), inner side members (15 and 35), and peripheral gusset members (16 and 36) which join the side members to form a garment receiving volume. The side members have a generally rectangular configuration and are of a congruent size and shape, as is known to persons skilled in the arts of making hanging garment bags.

Each of the bags 11, 31 has handle means 18, 38 secured to a face of the outer side member opposite the corresponding inner side member at a location approximately midway the height of the outer side member for accommodating handling of the garment bag in a folded condition. Each of the bags also preferably has a hanging handle means 19, 39 secured to the gusset member for suspension of the bag in a hanging position. As in known, each bag may also be provided with a closet hook for suspending the bag from a closet rod, pole or door.

Figure 2:
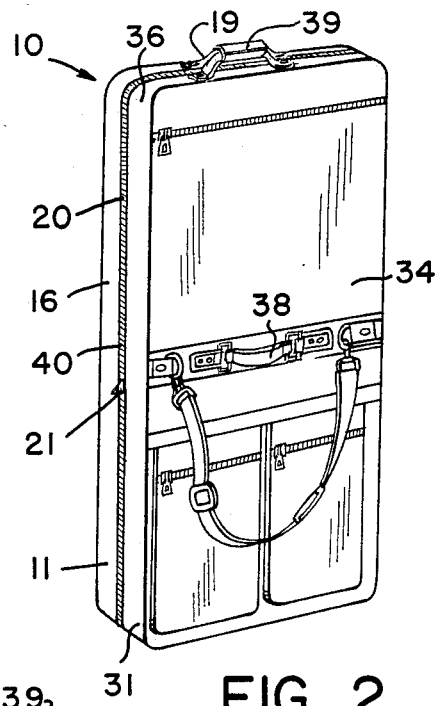
FIG. 2 is an elevation view of the bags of FIG. 1 unfolded for hanging.
Figure 3:
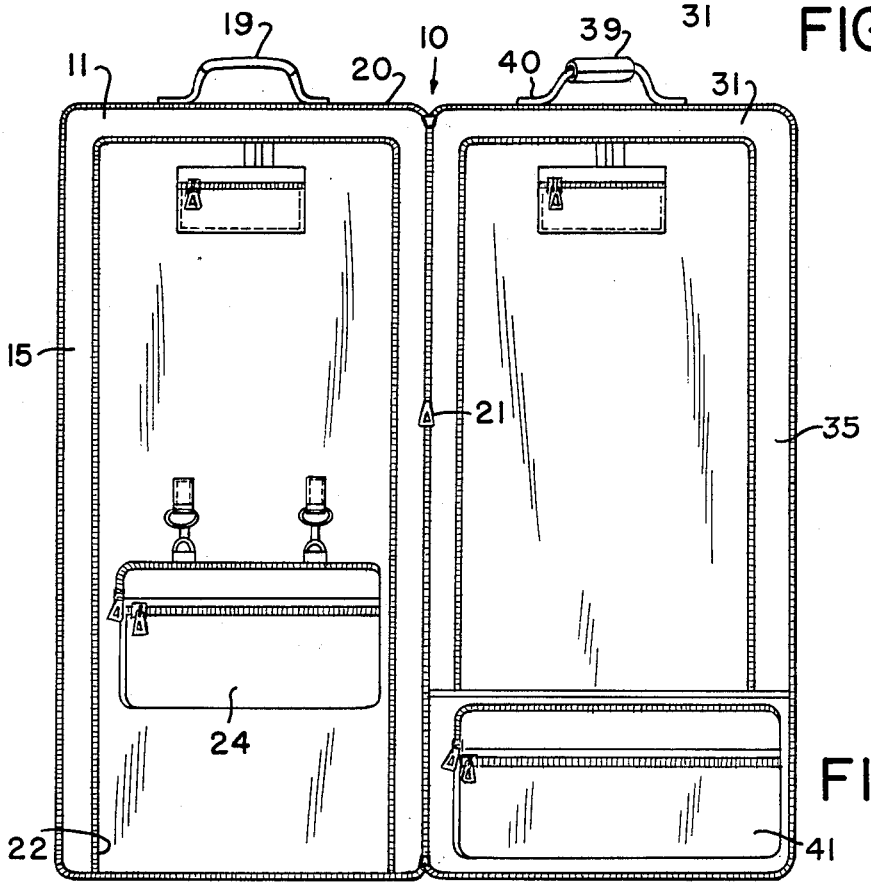
FIG. 3 is a view similar to FIG. 2, showing the bags of FIG. 1 partially separated one from another for access to garment compartments therewithin.
Figure 4:
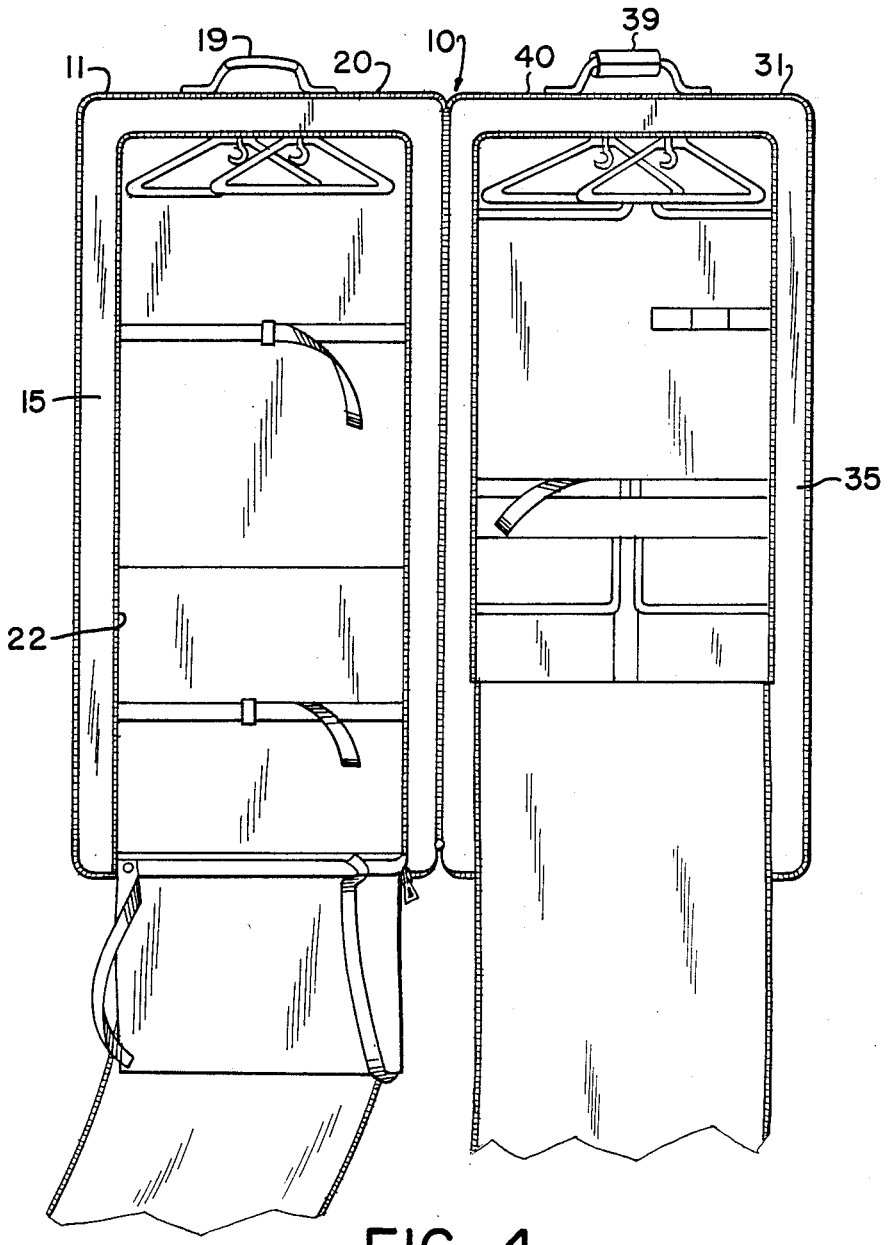
FIG. 4 is a view similar to FIG. 3, showing the bags of FIG. 1 opened for access to garment compartments therewithin.

In accordance with an important distinguishing feature of this invention, each bag 11, 31 has an elongate row of closure teeth 20, 40 encircling the periphery of the inner side member 15, 35 adjacent the junction of the inner side member and the gusset member 16, 36. The closure teeth are of the type known as forming one half of a chained tooth fastener or closure known as a zipper, and are of such size, configuration and spacing as to lock together when drawn together by a slide as is well known. A slide, indicated at 21, is provided on one of the bags 11, 31 for so joining the teeth 20, 40 on the two bags. By manipulation of the slide 21, the bags may be joined together (FIGS. 1 and 2) or may be separated for separate use. When joined together, the bags 11, 31 may be folded for ease in carrying and handling, and may be only partially separated so as to hang side by side from a closet rod or pole or door for access and use. When separated, the bags 11, 31 may be used individually, as desired and in a manner substantially similar to conventional bags.

One of the bags 11 is characterized by having, in the inner side member thereof, an elongate toothed closure 22 extending in an inverted U configuration from a bottom seam joining the gusset member 16 and the inner side member 15 to a height within a distance from the top end of the bag equal to no more than ten percent of the height of the bag when in an unfolded, hanging position for permitting access to substantially the full height of the interior volume of the bag. This bag 11 may be considered particularly well adapted for receiving garments such as dresses. The surface of the inner side member 15 which is exposed when the bag is closed preferably has fastener means such as D rings, hook and pile fabric tapes, or latching hooks which engage similar fasteners on a detachable pouch 24. The pouch 24, when attached, is spaced approximately medially of the height of the bag 11, for purposes to be made more clear hereinafter.

The other bag preferably may have an auxiliary compartment 41 attached thereto adjacent the lower end of the inner side member thereof and positioned to be disposed between the two garment bags 11, 31 when the bags are secured together. That side member has an elongate toothed closure extending in an inverted U configuration from a location just above the attachment of the auxiliary compartment to a height within a distance from the top end of the bag equal to one more than ten percent of the height of the bag when in an unfolded, hanging position for permitting access to the interior volume of the bag. These characteristics of the bag 31 may make it more useful to a man or a person traveling primarily with suits as clothing.

It is to be noted that the placement of the pouch 24 and auxiliary compartment 41 are such that, with the bags joined with the inner side members thereof abutting, the pouch and auxiliary compartment together take up one half the height of the bags, so as to be easily folded within the bags when they are folded for handling.

As is generally known, and as will be appreciated from the separate utility of the bags 11, 31, each gusset member has, adjacent the upper end of the bag, a hanger rail means for receiving hangers for garments. One bag 31 is also provided with a number of interior pockets for holding garments and the like. Both bags 11, 31 may be provided with exterior pockets accessible when the bags are joined together or when one bag is folded for individual use.

In the drawings and specifications there has been set forth a preferred emboidment of the invention and, although specific terms are used, the description thus given uses terminology in a generic and descriptive sense only and not for purposes of limitation.

What is claimed is:

1. A foldable, doubled, hanging garment bag comprising:

an elongate, rectangular first garment bag formed by a first outer side member having a predetermined generally rectangular configuration and top and bottom ends, a first inner side member having a predetermined generally rectangular configuration congruent with that of said first outer side member, a first peripheral gusset member joined with each of said first side members about the periphery thereof for defining with said first side members a contained volume for receiving garments, first handle means secured to a face of said first outer side member opposite said first inner side member at a location approximately midway the height of said first outer side member for accommodating handling of said first garment bag in a folded condition, and a first elongate row of closure teeth encircling the periphery of said first inner side member adjacent the junction of said first inner side member and said first gusset member; and an elongate, rectangular second garment bag formed by a second outer side member having a predetermined generally rectangular configuration congruent with that of said first outer side member and having top and bottom ends, a second inner side member having a predetermined generally rectangular configuration congruent with that of said second outer side member, a second peripheral gusset member joined with each of said second side members about the periphery thereof for defining with said second side members a contained volume for receiving garments, second handle means secured to a face of said second outer side member opposite said second inner side member at a location approximately midway the height of said second outer side member for accommodating handling of said second garment bag in a folded condition, and a second elongate row of closure teeth encircling the periphery of said second inner side member adjacent the junction of said second inner side member and said second gusset member, said first and second elongate rows of closure teeth being sized and spaced for locking engagement thereof, and slide means mounted on one of said first and second elongate rows of closure teeth for joining said teeth into a closed chain and thereby for joining said first and second garment bags together with said first and second inner side members adjoining and juxtaposed and said first and second handle means exposed on opposite faces of said joined garment bags, whereby said first and second garment bags may be joined for handling as a single garment bag having two separate contained volumes for receiving garments.

2. A doubled, hanging garment bag according to claim 1 wherein each of said gusset members has a corresponding top handle means secured thereto for accommodating handling of the corresponding garment bag while in an unfolded, hanging position.

3. A foldable, doubled, hanging garment bag comprising:

an elongate, rectangular first garment bag formed by a first outer side member having a predetermined generally rectangular configuration and top and bottom ends, a first inner side member having a predetermined generally rectangular configuration congruent with that of said first outer side member, a first peripheral gusset member joined with each of said first side members about the periphery thereof for defining with said first side members a contained volume for receiving garments, first handle means secured to a face of said first outer side member opposite said first inner side member at a location approximately midway the height of said first outer side member for accommodating handling of said first garment bag in a folded condition, and a first elongate row of closure teeth encircling the periphery of said first inner side member adjacent the junction of said first inner side member and said first gusset member; and an elongate, rectangular second garment bag formed by a second outer side member having a predetermined generally rectangular configuration congruent with that of said first outer side member and having top and bottom ends, a second inner side member having a predetermined generally rectangular configuration congruent with that of said second outer side member, a second peripheral gusset member joined with each of said second side members about the periphery thereof for defining with said second side members a contained volume for receiving garments, second handle means secured to a face of said second outer side member opposite said second inner side member at a location approximately midway the height of said second outer side member for accommodating handling of said second garment bag in a folded condition, and a second elongate row of closure teeth encircling the periphery of said second inner side member adjacent the junction of said second inner side member and said second gusset member, said first and second elongate rows of closure teeth being sized and spaced for locking engagement thereof, and slide means mounted on one of said first and second elongate rows of closure teeth for joining said teeth into a closed chain and thereby for joining said first and second garment bags together with said first and second inner side members adjoining and juxtaposed and said first and second handle means exposed on opposite faces of said joined garment bags, whereby said first and second garment bags may be joined for handling as a single garment bag having two separate contained volumes for receiving garments, and wherein one of said first and second inner side members has an elongate toothed closure extending in an inverted U configuration to a height within a distance from the top end of the corresponding one of said bags equal to no more than ten percent of the height of said corresponding one bag when in an unfolded, hanging position for permitting access to substantially the full height of the interior volume of the bag.

4. A doubled, hanging garment bag comprising:

an elongate, rectangular first garment bag formed by a first outer side member having a predetermined generally rectangular configuration and top and bottom ends, a first inner side member having a predetermined generally rectangular configuration congruent with that of said first outer side member, a first peripheral gusset member joined with each of said first side members about the periphery thereof for defining with said first side members a contained volume for receiving garments, first handle means secured to a face of said first outer side member opposite said first inner side member at a location approximately midway the height of said first outer side member for accommodating handling of said first garment bag in a folded condition, and a first elongate row of closure teeth encircling the periphery of said first inner side member adjacent the junction of said first inner said member and said first gusset member; and an elongate, rectangular second garment bag formed by a second outer side member having a predetermined generally rectangular configuration congruent with that of said first outer side member and having top and bottom ends, a second inner side member having a predetermined generally rectangular configuration congruent with that of said second outer side member, a second peripheral gusset member joined with each of said second side members about the periphery thereof for defining with said second side members a contained volume for receiving garments, second handle means secured to a face of said second outer side member opposite said second inner side member at a location approximately midway the height of said second outer side member for accommodating handling of said second garment bag in a folded condition, and a second elongate row of closure teeth encircling the periphery of said second inner side member adjacent the junction of said second inner side member and said second gusset member, said first and second elongate rows of closure teeth being sized and spaced for locking engagement thereof, and slide means mounted on one of said first and second elongate rows of closure teeth for joining said teeth into a closed chain and thereby for joining said first and second garment bags together with said first and second inner side members adjoining and juxtaposed and said first and second handle means exposed on opposite faces of said joined garment bags, whereby said first and second garment bags may be joined for handling as a single garment bag having two separate contained volumes for receiving garments, and wherein one of said first and second inner side members has an auxiliary compartment attached thereto adjacent the lower end of said one side member and positioned to be disposed between said first and second garment bags upon the same being secured together, and further wherein said one side member having said auxiliary compartment attached thereto has an elongate toothed closure extending in an inverted U configuration from a location just above the attachment of the auxiliary compartment to a height within a distance from the top end of the corresponding one of said bags equal to no more than ten percent of the height of said corresponding one bag when in an unfolded, hanging position for permitting access to the interior volume of the bag.

5. A doubled garment bag according to claim 4 where the other of said first and second inner side members has fastener means thereon at a location medial the height of said other side member when in an unfolded, hanging position, and further comprising a detachable pouch having cooperating fastener means thereon for securing said pouch to said other inner side member and having a height so correlated to the position of said fastener means on said side member and the height of said auxiliary compartment as to be positioned vertically adjacent to said auxiliary compartment upon juxtaposition of said first and second garment bags.

6. A doubled garment bag according to one of claims 3 or 4 wherein said garment bag having an inverted U shaped closure has pockets attached to an interior surface of the corresponding outer side member for receiving garments, said pockets being accessible through the opening provided by the inverted U shaped closure.

7. A doubled garment bag according to one of claims 3 or 4 wherein said garment bag having an inverted U shaped closure has hanger rail means attached to an interior surface of the corresponding gusset member for receiving hangers bearing garments, said hanger rail means being accessible through the opening provided by the inverted U shaped closure.

8. A foldable, doubled, hanging garment bag comprising:

an elongate, rectangular first garment bag formed by a first outer side member having a predetermined generally rectangular configuration and a top and bottom end, a first peripheral gusset member joined with said first outer side member about the periphery thereof for defining with said first side member a contained volume for receiving garments, a first inner side member having a predetermined generally rectangular configuration and being joined with said first peripheral gusset member for defining with said first outer side and gusset members a closed, contained volume for receiving garments, said first inner side member having an elongate toothed closure, handle means secured to a face of said first outer side member opposite the contained volume defined by said first outer side member and said first gusset member and said first inner side member and midway of the height of said first outer side member for facilitating handling of said garment bag when folded, a first hanging handle means secured to said first garment bag adjacent the top end of said first gusset member for suspension of said first garment bag in an unfolded, hanging position, and a first elongate row of closure teeth extending about at least about two thirds of the periphery of said first gusset member along the side thereof remote from the junction of said first outer side member and said first gusset member; and an elongate, rectangular second garment bag formed by a second outer side member having a predetermined generally rectangular configuration and a top and bottom end, a second peripheral gusset member joined with said second outer side member about the periphery thereof for defining with said second outer side member a contained volume for receiving garments, a second inner side member having a predetermined generally rectangular configuration congruent with that of said second outer side member and being joined with said second gusset member for defining with said second outer side and gusset members closed, contained volume for receiving garments, said second inner side member having an elongate toothed closure extending in an inverted U configuration to a height within a distance from the top end of said second bag equal to no more than ten percent of the height of said second bag, a second hanging handle means secured to said second garment bag adjacent the top end of said second gusset member for suspension of said garment bag in an unfolded, hanging position, and a second elongate row of closure teeth extending about at least about two thirds of the periphery of said second gusset member along the side thereof remote from the junction of said second outer side member and said second gusset member;

said first and second elongate rows of closure teeth being sized and spaced for locking engagement thereof, and slide means mounted on one of said first and second elongate rows of closure teeth for joining said teeth into a closed chain and thereby for joining said first and second garment bags together with said first and second gusset members adjoining and said first and second inner side members contiguous and juxtaposed, whereby said first and second garment bags may be joined for handling as a single garment bag having two separate closed, contained volumes for receiving garments.

* * * * *